US008072128B2

(12) United States Patent
Tanino et al.

(10) Patent No.: US 8,072,128 B2
(45) Date of Patent: Dec. 6, 2011

(54) FILAMENT LAMP

(75) Inventors: Kenji Tanino, Himeji (JP); Yoichi Mizukawa, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 35 days.

(21) Appl. No.: 12/557,941

(22) Filed: Sep. 11, 2009

(65) Prior Publication Data

US 2010/0079052 A1 Apr. 1, 2010

(30) Foreign Application Priority Data

Sep. 26, 2008 (JP) ..... 2008-247069

(51) Int. Cl.
*H01K 9/00* (2006.01)

(52) U.S. Cl. ..... 313/316; 313/318.02; 313/271; 313/272; 313/273; 313/275

(58) Field of Classification Search ..... 313/316, 313/579, 318.02, 271–275, 292; 392/411
See application file for complete search history.

(56) References Cited

U.S. PATENT DOCUMENTS 5,686,794 A 11/1997 Streppel et al.
6,713,945 B2 3/2004 Fuchs et al.
7,639,930 B2 12/2009 Mizukawa et al.
2006/0197454 A1 9/2006 Mizukawa et al.
2008/0203924 A1* 8/2008 Kitagawa et al. ..... 315/46
2009/0103905 A1* 4/2009 Tanino et al. ..... 392/411
2009/0243456 A1 10/2009 Tanino et al.
2010/0072876 A1* 3/2010 Nakashima et al. ..... 313/316

FOREIGN PATENT DOCUMENTS

EP 1 344 753 A1 9/2003
EP 1 998 358 A2 12/2008

* cited by examiner

*Primary Examiner* — Nimeshkumar Patel
*Assistant Examiner* — Mary Ellen Bowman
(74) *Attorney, Agent, or Firm* — Roberts Mlotkowski Safran & Cole, P.C.; David S. Safran

(57) ABSTRACT

To provide the structure of a filament lamp having a plurality of independent power supply pathways, the structure being capable of preventing the power supply pathways from electrically shorting to each other, a filament lamp formed of a straight-tube shaped luminous part having multiple filaments (F1, F2, F3) divided in the axial direction, and sealing parts (20) on each of opposite ends of the luminous part (10) in which are embedded metal foils (31, 32, 33) corresponding to the number of filaments in an aligned manner, and leads for supplying electricity independently to each filament, the luminous part (10) having a first housing space (11) for housing the filaments and a second housing space (12) for housing the leads (51, 52, 53), the housing spaces be connected and extending in the axial direction.

7 Claims, 3 Drawing Sheets

Fig. 1
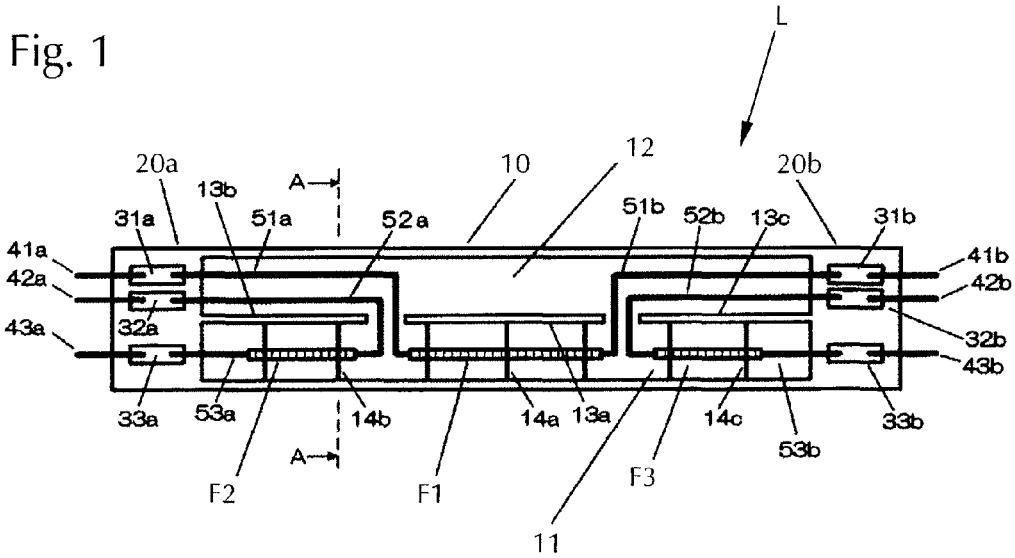
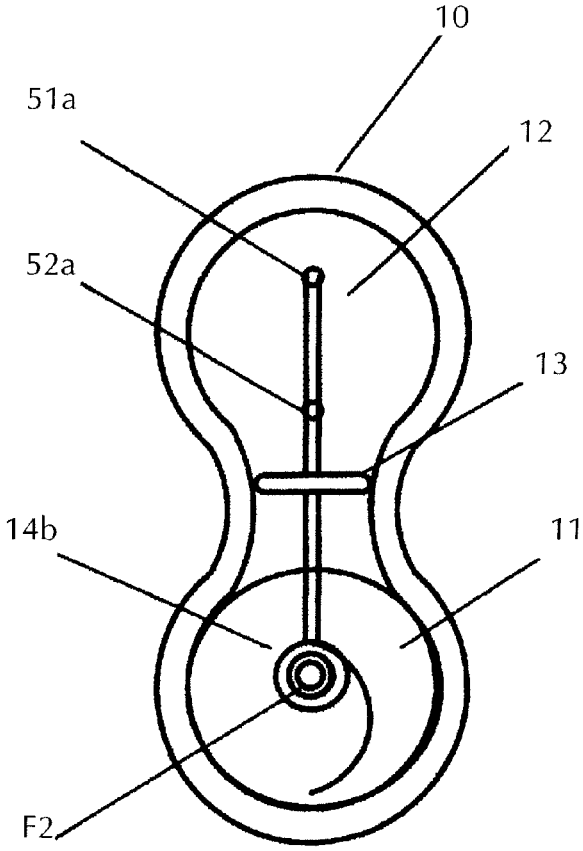
Fig. 2

Fig. 3 (a)
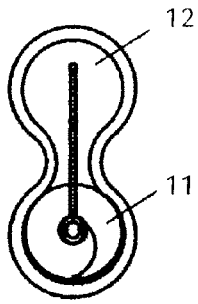
Fig. 3 (c)
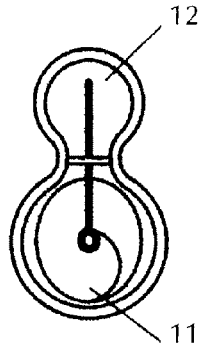
Fig. 3 (b)
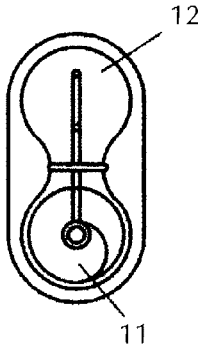
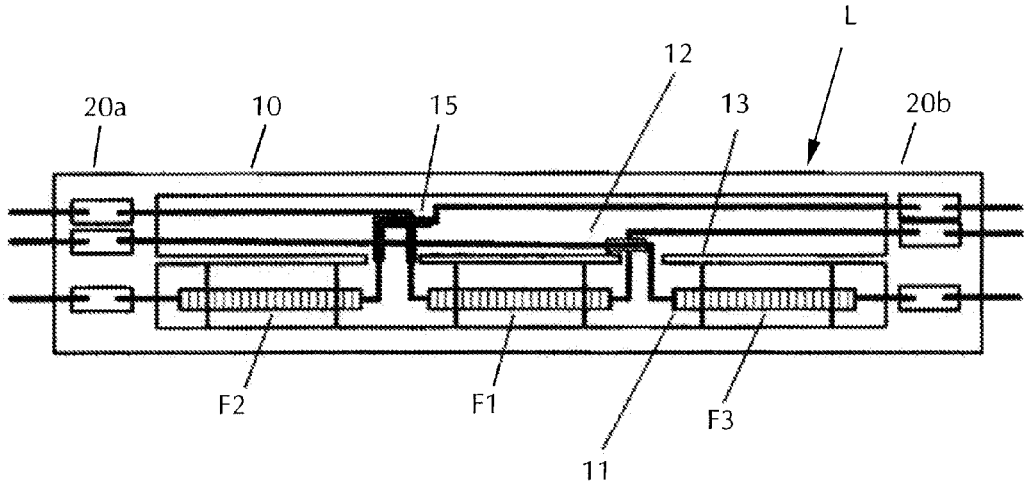
Fig. 4

Fig. 5
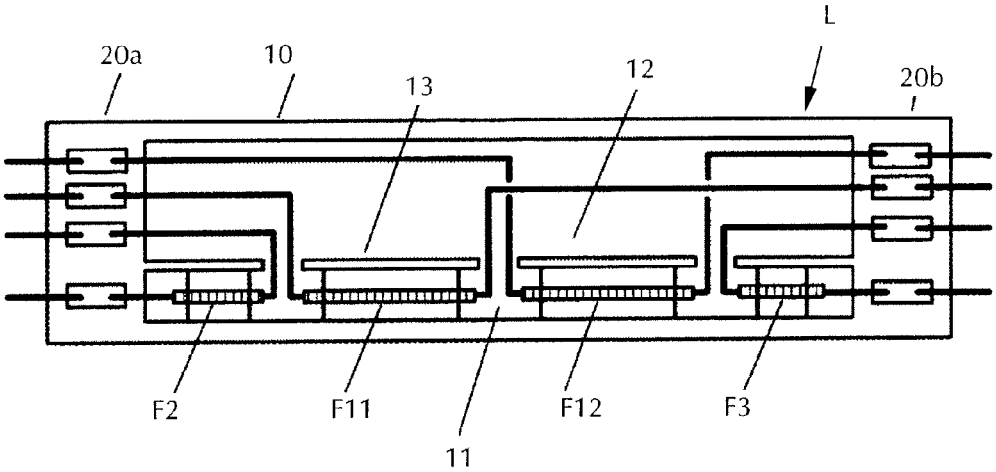
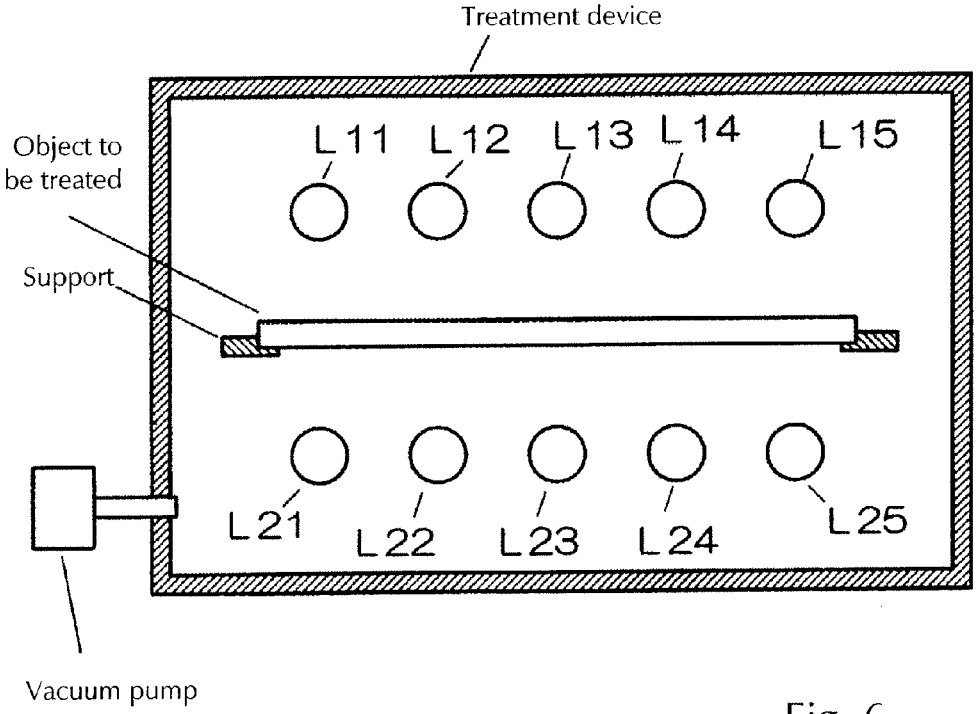
Fig. 6

FILAMENT LAMP

BACKGROUND OF THE INVENTION

1. Field of Invention

The present invention relates to a filament lamp, particularly to a filament lamp for heating an object to be treated.

2. Description of Related Art

The production steps for solar cells include a thermal diffusion step for diffusing a P type semiconductor and a baking step for baking silver paste to make electrode material. In both steps, a semiconductor wafer and a glass substrate are heated to a high temperature of around 800° C. to 900° C. using a thermal diffusion furnace and a baking furnace, respectively.

In such a heating device, an object to be treated must be heated uniformly in order to avoid a locational variation of temperature. For this reason, what has been proposed is a structure capable of providing multiple power supply pathways inside the luminous tube of a filament lamp as a light source and independently supplying a desired amount of electricity to each pathway (Japanese Laid-open Application No. 2006-279008 and corresponding U.S. Patent Application Publication 2006/0197454). However, the temperature to which an object to be treated is heated in the production steps noted above has been increasing, and the amount of electricity to be supplied to a lamp has also been increasing. On the other hand, the size of a lamp cannot be increased, and there is a demand for reducing the size thereof instead.

Each filament is connected with an internal lead for supplying electricity, and internal leads form complicated pathways inside a luminous tube. For this reason, there occurs a problem that an internal lead and a filament or two internal leads electrically short to each other or that a filament comes off a specified position. In other words, in a filament lamp having a plurality of independent power supply pathways, the lamp has an extremely complicated structure so that an object to be treated can be heated uniformly. As a result, the above-mentioned problems occur.

SUMMARY OF THE INVENTION

A primary object of the present invention is to provide a filament lamp having a plurality of independent power supply pathways in which the various problems, such as the positional deviation of a filament and short-circuiting, are efficiently prevented despite the presence of the complicated power supply pathways.

The filament lamp according to the present invention comprises a straight-tube type luminous part having multiple filaments divided in the axial direction, and sealing parts on opposite ends of the luminous part in which metal foils corresponding to the number of filaments are disposed in an aligned manner, wherein the structure is such that electricity can independently be supplied to each filament with respective leads, wherein the luminous part comprises a first housing space for housing the filaments and a second housing space for housing internal leads for supplying electricity, and wherein the housing spaces are paired and extend in the axial direction.

Furthermore, the present invention is also characterized in that the cross section of the luminous part is substantially gourd-shaped.

Furthermore, the present invention is also characterized in that the filaments are held in the first housing space with ring-shaped supporters.

This invention provides a structure in which the first housing space for housing the filaments and the second housing space for housing the internal leads for supplying electricity are paired and extend in the axial direction. Therefore, the problem that an internal lead and a filament or another lead electrically short to each other can be solved or reduced. Moreover, since the filaments can be held in the first housing space in which there exists no internal lead, the filaments can be positioned accurately.

BRIEF DESCRIPTION OF DRAWINGS

FIG. 1 shows the entire configuration of the filament lamp according to the present invention.

FIG. 2 shows the cross-sectional shape of the luminous part in the filament lamp according to the present invention.

FIG. 3 shows other examples of the cross-sectional shape of the luminous part in the filament lamp according to the present invention.

FIG. 4 shows another embodiment of the filament lamp according to the present invention.

FIG. 5 shows another embodiment of the filament lamp according to the present invention.

FIG. 6 shows a treatment device using the filament lamp according to the present invention.

DETAILED DESCRIPTION OF THE INVENTION

FIG. 1 shows the entire configuration of the filament lamp L according to the present invention which is comprised of a straight-tube type luminous part 10 and sealing parts 20*a*, 20*b* formed on opposite ends of luminous part 10. The luminous part 10 is formed of a first housing space 11 and a second housing space 12 as described below, and its cross section is substantially gourd-shaped as a whole (by which is meant that it is formed of sections that are at least internally circular that contain the first and second housing spaces 11, 12 and are connected to each other by a narrower neck portion, the circular sections not necessarily being of the same size; cf. FIG. 3(*c*)).

The first housing space 11 and the second housing space 12 are spatially linked with each other. Both spaces are paired and extend in the axial direction. Inside the first housing space 11 are disposed multiple filaments F1, F2, F3. Specifically, the filament F1 is disposed at the center in the longitudinal direction, the filament F2 on one end of the first housing space 11 (i.e., the end portion proximate to sealing part 20*a*), and filament F3 on the other end of the first housing space 11 (i.e., the end portion proximate to sealing part 20*b*). The filament F1, the filament F2 and the filament F3 are electrically separated from each other and aligned substantially on the central axis of the first housing space 11. Each of the filament F1, the filament F2 and the filament F3 is disposed in an independent power supply pathway.

Embedded in the sealing parts 20*a*, 20*b* are meal foils 31*a*, 32*a*, 33*a*, 31*b*, 32*b* 33*b*, corresponding to the number of the filaments F. Specifically, in the sealing part 20*a* are embedded the metal foil 31*a* for the filament F1, and the metal foils 32*a*, 33*a* for filament F2. In the sealing part 20*b* are embedded the metal foil 31*b* for filament F1, and metal foils 32*b*, 33*b* for filament F3.

The metal foils 30 are connected with external leads 41*a*, 42*a*, 43*a*, 41*b*, 42*b*, 43*b* that extend out of the lamp and internal leads 51*a*, 52*a*, 53*a*, 51*b*, 52*b*, 53*b* for supplying electricity and extend toward the inside of the luminous part 10. Specifically, the metal foil 31*a* is connected with the external lead 41*a* and the internal lead 51*a*, the metal foil 32*a* with the external lead 42*a* and the internal lead 52*a*, and the metal foil 33*a* with the external lead 43*a* and the internal lead 53*a*. Also, the metal foil 31*b* is connected with the external lead 41*b* and the internal lead 51*b*, the metal foil 32*b* with the external lead 42*b* and the internal lead 52*b*, and the metal foil 33*b* with the external lead 43*b* and the internal lead 53*b*.

The internal leads 51*a*, 51*b*, 52*a*, 52*b* are disposed in the second housing space 12. The internal leads 53*a*, 53*b* are disposed in the first housing space 11 in terms of the positional relationship with respect to the metal foils.

Partitions 13*a*, 13*b*, 13*c* are formed between the first housing space 11 and the second housing space 12. Specifically, the partition 13*b* is formed in order to spatially isolate the internal leads 51*a*, 52*a* from the filament F2. The partition 13*c* is formed in order to spatially isolate the internal leads 51*b*, 52*b* from the filament F3. The partition 13*a* corresponds to the filament F1 and extends along the filament F1 in the first housing space 11. The partitions 13*a*, 13*b*, 13*c* are made of the same material as used for the luminous part and are formed as parts of a single flat plate with holes through which the internal leads 51*a*, 52*a* and leads 51*b*, 52*b*, respectively, are routed. The partitions 13*a*, 13*c* are integrally welded together with the sealing parts 20*a*, 20*b*.

Each filament F1, F2, F3 is attached to respective ring-shaped supporters 14*a*, 14*b*, 14*c*. Each filament F is supported with multiple supporters 14 and positioned so that the filament F is substantially aligned with the central axis of the first housing space 11. Specifically, the filament F1 is supported with a pair of supporters 14*a*, the filament F2 with a pair of supporters 14*b* and the filament F3 with a pair of supporters 14*c*. Each supporter 14 is a spring-line member made, for example, of tungsten. Since it is ring-shaped, the supporter can be fixed on the inner wall of the first housing space 11 by force of elasticity. The supporters 14 are present only inside the first housing space 11, but not in the second housing space. The accuracy of positioning a filament can be enhanced by fixing a supporter inside a narrow space. Moreover, such problems as a short circuit can be prevented because the supporter does not come into contact with the internal lead 50.

Here, an independent electric power supply pathway is formed with the external lead 41*a*, the metal foil 31*a*, the internal lead 51*a*, the filament F1, the internal lead 51*b*, the metal foil 31*b* and the external lead 41*b*. The filament F1 emits light by applying a prescribed voltage to the external lead 41*a* and the external lead 41*b*. The filament F1 is disposed in the first housing space 11 while the internal lead 51*a* and the internal lead 51*b* are disposed in the second housing space 12.

Similarly, an independent electric power supply pathway is formed with the external lead 42*a*, the metal foil 32*a*, the internal lead 52*a*, the filament F2, the internal lead 53*a*, the metal foil 33*a* and the external lead 43*a*. The filament F2 emits light by applying a prescribed voltage to the external lead 42*a* and the external lead 43*a*. The filament F2 is disposed in the first housing space 11 while the internal lead 52*a* is disposed in the second housing space 12.

Moreover, an independent electric power supply pathway is formed with the external lead 42*b*, the metal foil 32*b*, the internal lead 52*b*, the filament F3, the internal lead 53*b*, the metal foil 33*b* and the external lead 43*b*. The filament F3 emits light by applying a prescribed voltage to the external lead 42*b* and the external lead 43*b*. The filament F3 is disposed in the first housing space 11 while the internal lead 52*b* is disposed in the second housing space 12.

The internal lead 50 may be provided with an insulating tube (not shown). The insulating tube is a pipe made of quartz glass, for example. It is effective if an insulating tube is provided at a place where another internal lead comes close.

In principle, the filaments F are housed in the first housing space 11 and the internal leads 50 in the second housing space 12 in the present invention. Nevertheless, the internal leads 53*a*, 53*b* for the filaments F2, F3, which are disposed on the end parts of the luminous part 10, may be housed in the first housing space for convenience sake. As far as the other internal leads 50 are concerned, the portions connected with the filaments F are partially disposed in the first housing space 11 while the portions extending in the longitudinal direction of the luminous part 10 are disposed in the second housing space 12.

As an example of the use of the filament lamp, an electric power of 3 kW is supplied to the filament F1 disposed at the center and an electric power of 600 kW to the filament F2 and filament F3 disposed on the end parts. The filament F1, the filament F2 and the filament F3 may be turned on at the same time, or one filament may be turned on and the other filaments turned off.

The filaments Fl, F2, F3 are coil-shaped and formed by tightly winding a single tungsten wire. The luminous part 10 is sealed with an inert gas such as argon (Ar) and nitrogen ($N_2$) together with a halogen, such as bromide (Br) or chlorine (Cl). As for the other aspects of the filament lamp relating to the present invention, please refer to Japanese Patent Application No. 2008-82458, a previous application of the assignee of the present application, and corresponding US Patent Application Publication 2009/0243456, which is incorporated herein by reference.

FIG. 2 shows a cross-sectional structure of the luminous part 10. Specifically, FIG. 2 shows the cross-sectional structure taken along line A-A in FIG. 1.

The cross section of the luminous part 10 as a whole is gourd-shaped as defined above. The first housing space 11 and the second housing space 12 are separated by partitions 13*a*, 13*b*, 13*c*. The gourd-shape of the luminous part 10 prevents or reduces the heating of the internal lead 50 caused by the radiant heat from the filaments F. In other words, if the internal leads are heated, some secondary radiation occurs and then an object to be heated is so disturbed that any uniform heating may be difficult. A protecting tube may be provided for the internal lead 50 in order to block radiation. However, there occurs a problem that cracks may occur arising out of an increased temperature of the protecting tube.

FIGS. 3(*a*)-3(*c*) show other embodiments of the cross-sectional shape of the luminous part 10. FIG. 3(*a*) shows a shape having no partition 13. FIG. 3(*b*) shows the luminous part 10 in which the external shape thereof is an oval, yet the cross section of the luminous space is substantially gourd-shaped internally. FIG. 3(*c*) shows an example in which the size of the first housing space 11 is different from that of the second housing space 12.

In FIG. 3(*a*), a partition is not required if the portion connecting the first housing space 11 with the second housing space 12 has a small internal diameter. This structure has the advantage that the number of parts is reduced so that the production is easier. Besides, the same function as that of a partition can be achieved by enlarging (elongating) the recessed portion of the luminous tube between the first housing space 11 and the second housing space 12.

In FIG. 3(*b*), the external shape of a luminous part need not be gourd-shaped if the cross section of the inner space of the luminous part is substantially gourd-shaped. The advantage of this structure is that the strength is increased by the increased thickness of the luminous part 10 in the area of the narrow connecting portion.

In FIG. 3(*c*), the first space 11 is enlarged for when a large filament is required emitting light with high power. Although, it is shown in the drawing that the first housing space 11 is larger than the second housing space 12, the second housing space 12 may be larger than the first housing space 11. The advantage is that the size can be reduced in the vertical direction when the first housing space 11 is larger and that an increased number of circuits can be managed well when the second housing space 12 is larger.

FIG. 4 shows another embodiment of the filament lamp according to the present invention. In the filament lamp as shown in FIG. 1, both of the external leads for the filament disposed in the vicinity of a sealing part protrude from the neighboring sealing part. On the other hand, the structure according to the present embodiment is such that all the filaments are provided with one external lead that protrudes from one sealing part and a second external lead that protrudes from the other sealing part. Specifically, while both of the external leads 42*a*, 43*a* of the filament F2 disposed in the vicinity of sealing part 20*a* protrude from the sealing part 20*a* in FIG. 1, each of the three metal foils embedded in the sealing part 20*a* is for a respective one of the filaments F1, F2, F3, and each of three metal foils embedded in the sealing part 20*b* is also for a respective one of the filaments F1, F2, F3 in FIG. 4. Accordingly, the structure is such that one terminal of each filament F protrudes from the sealing part 20*a* and the other terminal from the sealing part 20*b*. This is true for all the filaments F. In the filament lamp having such a structure, all the filaments F are housed in the first housing space 11 and the internal leads 50 in the second housing space 12 as well.

FIG. 5 shows another embodiment of the filament lamp according to the present invention. The filament as shown in FIG. 5 is different from the filament lamps as shown in FIGS. 1 & 4 in that the lamp of FIG. 5 has four filaments that can independently be supplied with electric power while that of FIGS. 1 & 4 has three filaments. At the center of a luminous part 10 are disposed a filament F11 and a filament F12. On one end of the luminous part 10 (i.e., the end portion close to the sealing part 20*a*) is disposed a filament F3. On the other end (i.e., the end portion close to the sealing part 20*b*) is disposed a filament F2. The filament F11, the filament F12, the filament F2 and the filament F3 are disposed in parallel with the central axis of the luminous part 10. In the filament lamp having such a structure, all the filaments F are housed in the first housing space 11 and the internal leads 50 in the second housing space 12 in principle as well. As for the structure of a lamp having four filaments, please refer to FIG. 4 in Japanese Patent Application No. 2008-82458 and corresponding, commonly owned U.S. patent application Ser. No. 12/402,853.

Next, a description of a method for manufacturing the luminous tube (i.e., a glass tube before sealing) of the filament lamp according to the present invention is given below.

First, melt quartz powder at a high temperature and make an ingot having a shape similar to one desired to be produced using a metallic mold. Tube-draw the ingot to a shape desired to be produced (i.e., a gourd shape). If the desired shape to be produced is complicated, an ingot may be shaped by cutting and then tube-drawn in the same manner. After the tube drawing, a partition is formed between the first housing space and the second housing space. Alternatively, quartz powder may directly be tube-drawn at the same time that it is melted.

Insert a mount formed by connecting filaments, internal leads, metal foils and external leads into a glass tube thus produced. Then, make a lamp by sealing (pinch sealing) both ends of the glass tube.

FIG. 6 shows a schematic configuration of a heat treatment device in which the filament lamp according to the present invention is used.

Inside a chamber of the treatment device is disposed an object to be treated. Also disposed are filament lamps lamp L11, L12, L13, L14, L15 facing the front/top surface of the object to be treated and filament lamps L21, L22, L23, L24, L25 facing the rear/bottom surface of the object to be treated. The treatment device is connected with a vacuum pump to maintain the space inside the device with a reduced pressure atmosphere. The object to be treated is held by a support.

In the present invention, the term "metal foils corresponding to the number of filaments" does not necessarily refer to the provision of the same number of metal foils as the number of filaments. For example, the filament F1 in FIG. 1 may be divided in the longitudinal direction to make multiple filaments.

What is claimed is:

1. A filament lamp, comprising:

a straight-tube luminous part having multiple filaments arranged one after the other in an axial direction of the luminous part, and sealing parts on each of opposite ends of the luminous part in which metal foils corresponding to the number of filaments are disposed in an aligned manner, internal leads provided for each of the filaments in a manner enabling electricity to be independently supplied to each filament, wherein the luminous part comprises a first housing space for housing the filaments and a second housing space for housing the internal leads; and wherein the housing spaces are laterally connected along the length thereof by a narrowed space and extend in the axial direction.

2. The filament lamp according to claim 1, wherein a transverse cross section of the luminous part is at least internally substantially gourd-shaped.

3. The filament lamp according to claim 1, wherein the filaments are held in the first housing space by ring-shaped supporters.

4. The filament lamp according to claim 2, wherein the cross section of the luminous part is substantially gourd-shaped internally and externally.

5. The filament lamp according to claim 2, wherein the cross section of the luminous part is substantially gourd-shaped internally and has an oval shape externally.

6. The filament lamp according to claim 1, wherein the first and second housing spaces are of the same size.

7. The filament lamp according to claim 1, wherein the first and second housing spaces are of different sizes.

* * * * *